US011473388B2

(12) United States Patent
Al-Kunin

(10) Patent No.: US 11,473,388 B2
(45) Date of Patent: Oct. 18, 2022

(54) TUBING HEAD ADAPTERS WITH MULTIPLE BACK PRESSURE VALVES AND METHODS OF ISOLATING PRODUCTION TUBING

(71) Applicant: Saudi Arabian Oil Company, Dhahran (SA)

(72) Inventor: Abdullah Radi Ali Al-Kunin, Alhasa (SA)

(73) Assignee: Saudi Arabian Oil Company, Dhahran (SA)

( * ) Notice: Subject to any disclaimer, the term of this patent is extended or adjusted under 35 U.S.C. 154(b) by 27 days.

(21) Appl. No.: 17/200,069

(22) Filed: Mar. 12, 2021

(65) Prior Publication Data

US 2022/0290523 A1 Sep. 15, 2022

(51) Int. Cl.
*E21B 34/02* (2006.01)
*E21B 33/04* (2006.01)
*E21B 33/068* (2006.01)

(52) U.S. Cl.
CPC ..... *E21B 33/068* (2013.01); *E21B 33/04* (2013.01); *E21B 34/02* (2013.01)

(58) Field of Classification Search
CPC ..... E21B 34/02; E21B 33/04
See application file for complete search history.

(56) References Cited

U.S. PATENT DOCUMENTS 6,763,891 B2 7/2004 Humphrey et al.
10,156,122 B2 12/2018 Nguyen et al.
2004/0173348 A1* 9/2004 Kwasniewski ..... E21B 33/068 166/85.1
2005/0016736 A1 1/2005 Dallas
2018/0163505 A1 6/2018 Montoya et al.
2018/0163506 A1 6/2018 Montoya et al.

FOREIGN PATENT DOCUMENTS

GB 818820 A 8/1959
WO 2016109133 A1 7/2016

OTHER PUBLICATIONS

Fetoui, "Back-Pressure Valve installed in tubing hangers", Production Technology, Nov. 28, 2018.
International Search Report and Written Opinion dated Nov. 18, 2021 pertaining to International application No. PCT/US2021/028835 filed Apr. 23, 2021, 14 pages.

* cited by examiner

*Primary Examiner* — Giovanna Wright
(74) *Attorney, Agent, or Firm* — Dinsmore & Shohl LLP

(57) ABSTRACT

A wellhead may include a first back pressure valve, a second back pressure valve, and a tubing head adapter. The tubing head adapter may include a first and second back pressure valve set location that complements and engages an outer surface profile of the first and second back pressure valve, respectively. The first back pressure valve set location may be positioned below the second back pressure valve set location. A first back pressure valve receiving diameter of the first back pressure valve set location may be smaller than a second back pressure valve receiving diameter of the second back pressure valve set location. A method of isolating production tubing in fluid communication with a wellhead may include engaging a first and second back pressure valve at a first and second, respectively, back pressure valve set location of the tubing head adapter.

14 Claims, 4 Drawing Sheets

TUBING HEAD ADAPTERS WITH MULTIPLE BACK PRESSURE VALVES AND METHODS OF ISOLATING PRODUCTION TUBING

BACKGROUND

The present disclosure relates to wellheads for insertion above a well and, more specifically, to wellhead tubing head adapters and methods of isolating production tubing in fluid communication with wellheads.

BRIEF SUMMARY

Once a well has been completed, a wellhead is installed above the production tubing. The wellhead includes spools, valves and assorted adapters that provide pressure control of a production well. During the life of a production well, it must be monitored, maintained and, in many cases, mechanically altered in response to changing conditions. A well workover, or intervention, is a process of performing major maintenance or remedial treatments on an oil or gas well. Well workovers, or interventions, are performed by inserting tools in wellbores to conduct maintenance or remedial actions. In many cases, a workover involves the removal of the wellhead fluid control tree, after the well has been killed and a workover rig has been placed on location.

To ensure a safe well workover or intervention, it is necessary to provide a means for positive well control, such that the production tubing is isolated from the surface. While it is important to maintain a safe and controlled environment during well workover or intervention, it is also important to return the production well to a producing state.

Accordingly, there is an ongoing need for apparatuses and methods that allow for safe and efficient isolation of a production well during well workover or intervention. The apparatuses and methods of the present disclosure meet this need through a tubing head adapter with multiple back pressure valves.

According to one or more aspects of the present disclosure, a method of isolating production tubing in fluid communication with a wellhead may include removing a tree cap of a wellhead comprising a longitudinal axial bore and a tubing head adapter positioned in the longitudinal axial bore, the tubing head adapter comprising a first back pressure valve set location and a second back pressure valve set location. The first back pressure valve set location may include a first back pressure valve receiving diameter and the second back pressure valve set location may include a second back pressure valve receiving diameter. The first back pressure valve receiving diameter of the first back pressure valve set location may be smaller than the second back pressure valve receiving diameter of the second back pressure valve set location. The method may further include attaching a first back pressure valve to a back pressure valve running tool, inserting the first back pressure valve and the back pressure valve running tool along the longitudinal axial bore of the wellhead into the tubing head adapter and past the second back pressure valve set location, engaging the first back pressure valve at the first back pressure valve set location of the tubing head adapter, and releasing the first back pressure valve from the back pressure valve running tool and removing the back pressure valve running tool from the longitudinal axial bore of the wellhead. The method may further include attaching a second back pressure valve to the back pressure valve running tool, inserting the second back pressure valve and the back pressure valve running tool along the longitudinal axial bore of the wellhead into the tubing head adapter, engaging the second back pressure valve at the second back pressure valve set location of the tubing head adapter, and releasing the second back pressure valve from the back pressure valve running tool and removing the back pressure valve running tool from the longitudinal axial bore of the wellhead. The engagement of the first back pressure valve at the first back pressure valve set location and the second back pressure valve at the second back pressure valve set location may isolate the production tubing from the wellhead.

According to one or more other aspects of the present disclosure, a wellhead for insertion above a well may include a fluid control tree, a tubing head spool, a first back pressure valve, a second back pressure valve, and a tubing head adapter. The fluid control tree may include at least one fluid control valve to direct fluid along a longitudinal axial bore of the wellhead through the first back pressure valve, the second back pressure valve, and the tubing head adapter to production tubing supported by the tubing head spool and the tubing head adapter. The tubing head spool may support the tubing head adapter and may be secured to the fluid control tree via the tubing head adapter. The tubing head adapter may include a first back pressure valve set location that complements and engages an outer surface profile of the first back pressure valve to fix a position of the first back pressure valve in at least one direction along the longitudinal axial bore of the wellhead. The tubing head adapter also includes a second back pressure valve set location that complements and engages an outer surface profile of the second back pressure valve to fix a position of the second back pressure valve in at least one direction along the longitudinal axial bore of the wellhead. The first back pressure valve set location may be positioned below the second back pressure valve set location. The first back pressure valve set location may include a first back pressure valve receiving diameter and the second back pressure valve set location may include a second back pressure valve receiving diameter. The first back pressure valve receiving diameter of the first back pressure valve set location may be smaller than the second back pressure valve receiving diameter of the second back pressure valve set location. The first back pressure valve and the second back pressure valve may isolate the production tubing from the wellhead.

BRIEF DESCRIPTION OF THE SEVERAL VIEWS OF THE DRAWINGS

The following detailed description of specific embodiments of the present disclosure can be best understood when read in conjunction with the following drawings, where like structure is indicated with like reference numerals and in which.

DETAILED DESCRIPTION

Figure 1:
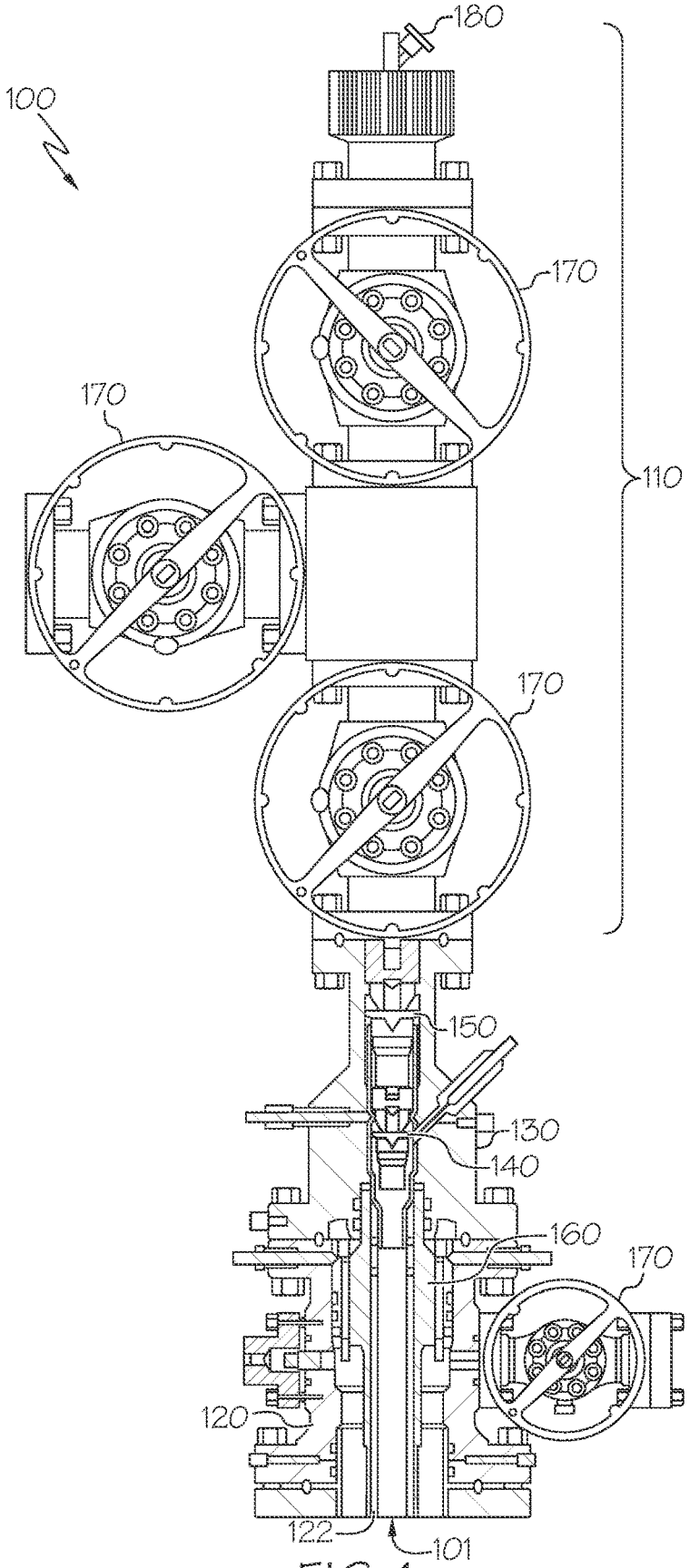
FIG. 1 is a schematic illustration of a wellhead for insertion above a well according to one embodiment of the present disclosure.
Figure 2:
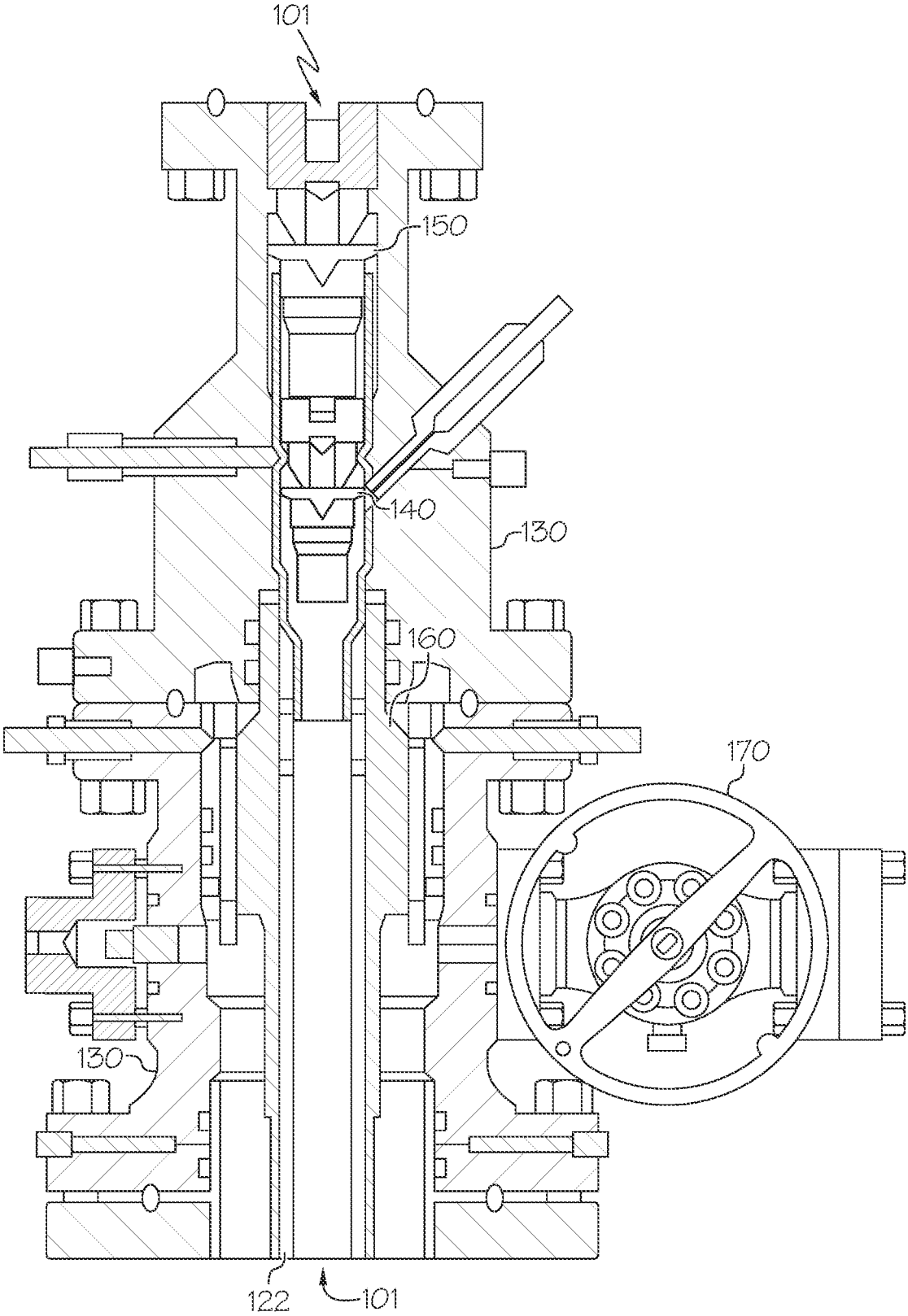
FIG. 2 is a schematic cross-sectional illustration of a tubing head adapter of a wellhead for insertion above a well according to one embodiment of the present disclosure.

Referring initially to FIGS. 1 and 2, a wellhead 100 for insertion above a well is schematically depicted. The wellhead 100 may include a fluid control tree 110, a tubing head spool 120, a tubing head adapter 130, a first back pressure valve 140, a second back pressure valve 150, and a tubing hanger 160. The fluid control tree may include at least one fluid control valve 170 to direct fluid along a longitudinal axial bore 101 of the wellhead 100. The fluid may be directed through the first back pressure valve 140, the second back pressure valve 150, and the tubing head adapter 130 to production tubing 122 supported by the tubing head spool 120. The tubing head spool 120 may support the tubing hanger 160 and may be secured to the fluid control tree 110 via the tubing head adapter 130. The tubing head adapter 130 may include a first back pressure valve set location 142 and a second back pressure valve set location 152. The first back pressure valve set location 142 may complement and engage an outer surface profile of the first back pressure valve 140 to fix a position of the first back pressure valve 140 in at least one direction along the longitudinal axial bore 101 of the wellhead 100. The second back pressure valve set location 152 may complement and engage an outer surface profile of the second back pressure valve 150 to fix a position of the second back pressure valve 150 in at least one direction along the longitudinal axial bore 101 of the wellhead 100. The first back pressure valve set location 142 may be positioned below the second back pressure valve set location 152. The first back pressure valve set location 142 may include a first back pressure valve receiving diameter. The second back pressure valve set location 152 may include a second back pressure valve receiving diameter. The first back pressure valve receiving diameter of the first back pressure valve set location 142 may be smaller than the second back pressure valve receiving diameter of the second back pressure valve set location 152. The first back pressure valve 140 and the second back pressure valve 150 may isolate the production tubing 122 from the wellhead 100.

The components of the wellhead 100 (i.e., the fluid control tree 110, the tubing head spool 120, the tubing head adapter 130, the first back pressure valve 140, the second back pressure valve 150, and the tubing hanger 160) may be any conventional or yet-to-be developed components. It is contemplated that existing tubing head adapters 130 may be modified such that they include a first back pressure valve set location 142 and a second back pressure valve set location 152 as described in the present disclosure.

In many well workover or intervention procedures, multiple pressure control devices are required to safely isolate the production tubing 122. Some pressure control devices (such as PR plugs, bridge plugs and Monolock® plugs) may require additional time to install. Additional time to install these pressure barriers results in the well being out of production for a longer time, such that the well is not producing. Conversely, back pressure valves may be run using a back pressure valve running tool to tubing head adapters 130 of the present disclosure which requires much less time and effort for installation.

Figure 3:
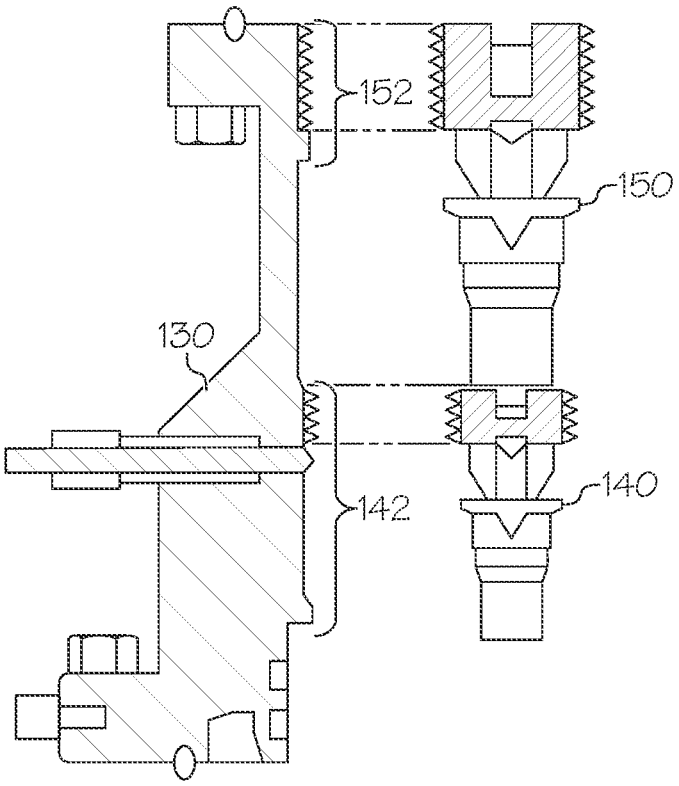
FIG. 3 is another schematic cross-sectional illustration of a tubing head adapter of a wellhead for insertion above a well according to one embodiment of the present disclosure.
Figure 4:
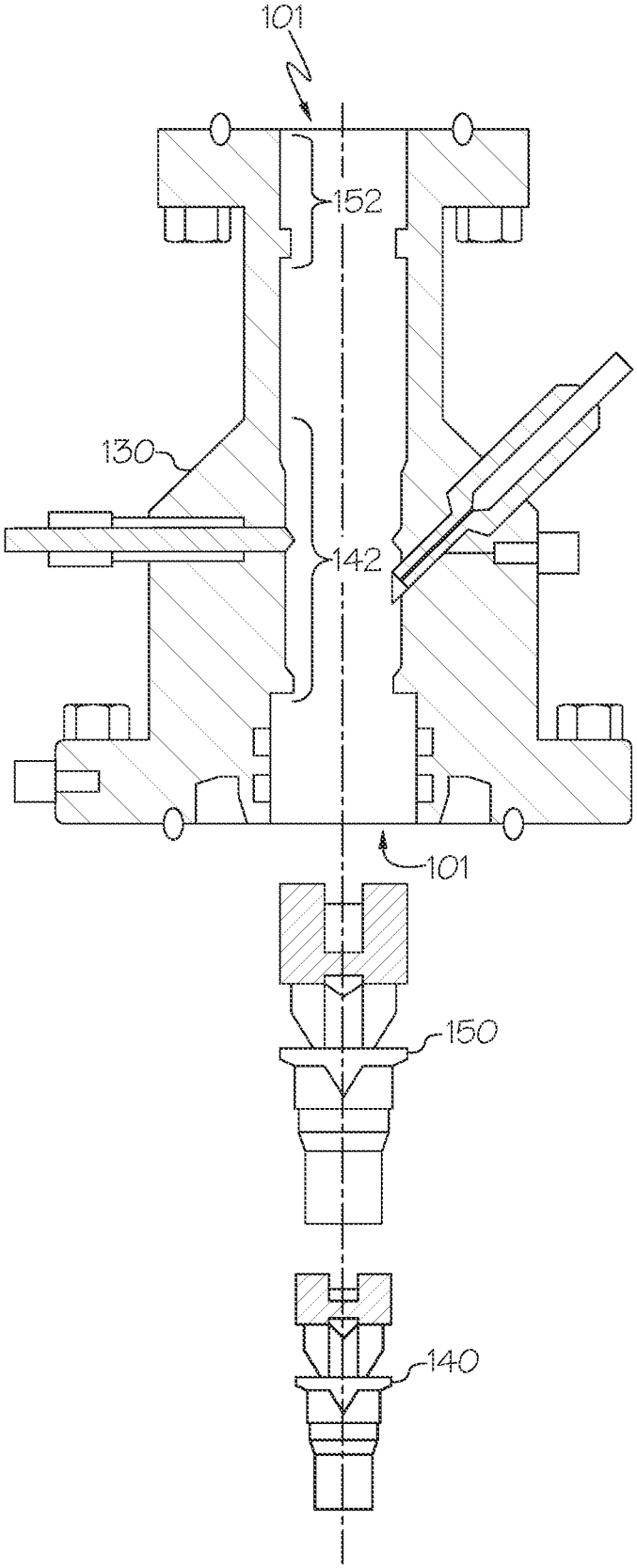
FIG. 4. is yet another schematic cross-sectional illustration of a tubing head adapter of a wellhead for insertion above a well according to one embodiment of the present disclosure.

Referring now to FIGS. 3 and 4, the first back pressure valve set location 142 may be positioned vertically below the second back pressure valve set location 152. In embodiments, the first back pressure valve set location 142 may comprise a smaller diameter than the second back pressure valve set location 152. When the first back pressure valve set location 142 comprises a smaller diameter than the second back pressure valve set location 152, the first back pressure valve 140 may easily be inserted into the tubing head adapter 130 and passed through the second back pressure valve set location 152. In other embodiments, the first back pressure valve set location 142 may comprise a diameter equal to the second back pressure valve set location 152.

Referring to FIG. 3, in embodiments, the first back pressure valve set location 142, the second back pressure valve set location 152, or both, may include a set location threaded profile that complements a back pressure valve threaded profile of the first back pressure valve 140, the second back pressure valve 150, or both, respectively. The inner diameter of the threaded profiles of first back pressure valve set location 142 threaded profile, the second back pressure valve set location 152 threaded profile, or both, may be greater than or equal to 3 inches (7.62 centimeters) and less than or equal to 6 inches (15.24 centimeters).

Referring to any of FIGS. 1-4, it is contemplated that the first back pressure valve 140 and the second back pressure valve 150 may be any conventional or yet to be developed back pressure valve. As used herein, a "back pressure valve" may comprise a type of check valve designed to hold pressure from one side of the valve yet enable fluids to be pumped from the other side of the valve. The first back pressure valve 140 and the second back pressure valve 150 may be the same or different type of back pressure valves. In embodiments, the first back pressure valve 140, the second back pressure valve 150, or both, may be type-H back pressure valves. The first back pressure valve 140 and the second back pressure valve 150 may maintain well integrity when the fluid control tree 110 is removed, such as for well workover or intervention.

In one embodiment, the first back pressure valve 140, the second back pressure valve 150, or both may be a 3-63/64 inch (10.12 centimeter) back pressure valve, a 4-1/16 inch (10.32 centimeter) back pressure valve, a 4-3/32 inch (10.40 centimeter) back pressure valve, or a 5-1/8 inch (13.02 centimeter) back pressure valve. For example, the first back pressure valve 140 may be a 4-1/16 inch (10.32 centimeter) back pressure valve and the second back pressure valve 150 may be a 5-1/8 inch (13.02 centimeter) back pressure valve.

In embodiments, a synthetic seal may be positioned between the first back pressure valve 140 or the second back pressure valve 150 and the first back pressure valve set location 142 or the second back pressure valve set location, 152 respectively. For example, the synthetic seal may be, but is not limited to, an elastomeric seal. Additionally or alternatively, a metal-to-metal seal may be formed between the first back pressure valve 140 or the second back pressure valve 150 and the first back pressure valve set location 142 or the second back pressure valve set location 152, respectively. A "metal-to-metal seal" refers to a seal produced by metal-to-metal contact between the sealing face of the seat ring (e.g., a back pressure valve set location) and the closure elements (e.g., a back pressure valve), without benefit of a synthetic seal, as will be appreciated by those skilled in the art.

The present disclosure is also directed to methods of isolating production tubing 122 in fluid communication with a wellhead 100. The method may include removing a tree cap 180 of the wellhead 100. As previously discussed in the present disclosure, the wellhead 100 may include the longitudinal axial bore 101 and the tubing head adapter 130 positioned in the longitudinal axial bore 101. Also, as previously discussed, the tubing head adapter 130 may include the first back pressure valve set location 142 having a first back pressure valve receiving diameter and the second back pressure valve set location 152 having a second back pressure valve receiving diameter. Further, the first back pressure valve receiving diameter of the first back pressure valve set location 142 may be smaller than the second back pressure valve receiving diameter of the second back pressure valve set location 152.

The method may further include attaching the first back pressure valve 140 to a back pressure valve running tool, inserting the first back pressure valve 140 and the back pressure valve running tool along the longitudinal axial bore 101 of the wellhead 100 into the tubing head adapter 130 and past the second back pressure valve set location 152, and engaging the first back pressure valve 140 at the first back pressure valve set location 142 of the tubing head adapter 130. After releasing the first back pressure valve 140 from the back pressure valve running tool, the method may include removing the back pressure valve running tool from the longitudinal axial bore 101 of the wellhead 100. The method may also include attaching the second back pressure valve 150 to the back pressure valve running tool, inserting the second back pressure valve 150 and the back pressure valve running tool along the longitudinal axial bore 101 of the wellhead 100 into the tubing head adapter 130, engaging the second back pressure valve 150 at the second back pressure valve set location 152 of the tubing head adapter 130, and releasing the second back pressure valve 150 from the back pressure valve running tool and removing the back pressure valve running tool from the longitudinal axial bore 101 of the wellhead 100. Engagement of the first back pressure valve 140 at the first back pressure valve set location 142 and the second back pressure valve 150 at the second back pressure valve set location 152 may isolate the production tubing 122 from the wellhead 100.

The wellhead 100, the first back pressure valve set location 142, the second back pressure valve set location 152, the first back pressure valve 140, the second back pressure valve 150, and the tubing head adapter 130 may have any feature or characteristic as previously described in the present disclosure.

In embodiments of the present disclosure, isolating production tubing 122 in fluid communication with the wellhead 100 does not include using a plug. Plugs, such as PR plugs may be set using a slickline unit. The use of a slickline unit may require additional time to install the plug and, therefore, increase the amount of time the well is not producing. It will be appreciated by those skilled in the art that the apparatuses and methods of the present disclosure that do not require using a plug will increase the efficiency of performing well workover or intervention while safely isolating the production tubing 122.

In embodiments, the method may further include pumping a fluid past the first back pressure valve 140 and the second back pressure valve 150 to kill the well. The fluid may be a kill fluid. As used in the present disclosure, a "kill fluid" may refer to a fluid with a density high enough to produce a hydrostatic pressure at the point of influx in a wellbore that is sufficient to shut off flow to the well.

One or more aspects of the present disclosure are described here. A first aspect of the present disclosure may include a method of isolating production tubing in fluid communication with a wellhead, the method comprising: removing a tree cap of a wellhead comprising a longitudinal axial bore and a tubing head adapter positioned in the longitudinal axial bore, the tubing head adapter comprising a first back pressure valve set location and a second back pressure valve set location, wherein the first back pressure valve set location comprises a first back pressure valve receiving diameter; the second back pressure valve set location comprises a second back pressure valve receiving diameter; and the first back pressure valve receiving diameter of the first back pressure valve set location is smaller than the second back pressure valve receiving diameter of the second back pressure valve set location; attaching a first back pressure valve to a back pressure valve running tool; inserting the first back pressure valve and the back pressure valve running tool along the longitudinal axial bore of the wellhead into the tubing head adapter and past the second back pressure valve set location; engaging the first back pressure valve at the first back pressure valve set location of the tubing head adapter; releasing the first back pressure valve from the back pressure valve running tool and removing the back pressure valve running tool from the longitudinal axial bore of the wellhead; attaching a second back pressure valve to the back pressure valve running tool; inserting the second back pressure valve and the back pressure valve running tool along the longitudinal axial bore of the wellhead into the tubing head adapter; engaging the second back pressure valve at the second back pressure valve set location of the tubing head adapter; and releasing the second back pressure valve from the back pressure valve running tool and removing the back pressure valve running tool from the longitudinal axial bore of the wellhead, wherein the engagement of the first back pressure valve at the first back pressure valve set location and the second back pressure valve at the second back pressure valve set location isolates the production tubing from the wellhead.

A second aspect of the present disclosure may include the first aspect, wherein the first back pressure valve set location is positioned vertically below the second back pressure valve set location.

A third aspect of the present disclosure may include either the first aspect or second aspect, wherein the first back pressure valve, the second back pressure valve, or both, are type-H back pressure valves.

A fourth aspect of the present disclosure may include any one of the first through third aspects, wherein the first back pressure valve comprises a smaller outer diameter than the second back pressure valve.

A fifth aspect of the present disclosure may include any one of the first through fourth aspects, wherein the first back pressure valve set location, the second back pressure valve set location, or both, comprise a set location threaded profile that complements a back pressure valve threaded profile of the first back pressure valve, the second back pressure valve, or both, respectively.

A sixth aspect of the present disclosure may include the fifth aspect, wherein an inner diameter of the threaded profiles of first back pressure valve set location threaded profile, the second back pressure valve set location, or both, is greater than or equal to 3 inches (7.62 centimeters) and less than or equal to 6 inches (15.24 centimeters).

A seventh aspect of the present disclosure may include any one of the first through sixth aspects, wherein engaging the first back pressure valve at the first back pressure valve set location, engaging the second back pressure valve at the second back pressure valve set location, or both, comprises threading the back pressure valve threaded profile into the complementary set location threaded profile.

An eighth aspect of the present disclosure may include any one of the first through seventh aspects, wherein the method further comprises pumping a fluid past the first back pressure valve and the second back pressure valve to kill the well.

A ninth aspect of the present disclosure may include any one of the first through eighth aspects, wherein isolating production tubing in fluid communication with the wellhead does not include using a plug.

A tenth aspect of the present disclosure may include a wellhead for insertion above a well, the wellhead comprising: a fluid control tree, a tubing head spool, a first back pressure valve, a second back pressure valve, and a tubing head adapter, wherein: the fluid control tree comprises at least one fluid control valve to direct fluid along a longitudinal axial bore of the wellhead through the first back pressure valve, the second back pressure valve, and the tubing head adapter to production tubing supported by the tubing head spool and the tubing head adapter; the tubing head spool supports the tubing head adapter and is secured to the fluid control tree via the tubing head adapter; the tubing head adapter comprises a first back pressure valve set location that complements and engages an outer surface profile of the first back pressure valve to fix a position of the first back pressure valve in at least one direction along the longitudinal axial bore of the wellhead; the tubing head adapter comprises a second back pressure valve set location that complements and engages an outer surface profile of the second back pressure valve to fix a position of the second back pressure valve in at least one direction along the longitudinal axial bore of the wellhead; the first back pressure valve set location is positioned below the second back pressure valve set location; the first back pressure valve set location comprises a first back pressure valve receiving diameter; the second back pressure valve set location comprises a second back pressure valve receiving diameter; the first back pressure valve receiving diameter of the first back pressure valve set location is smaller than the second back pressure valve receiving diameter of the second back pressure valve set location; and the first back pressure valve and the second back pressure valve isolate the production tubing from the wellhead.

An eleventh aspect of the present disclosure may include the tenth aspect, wherein the first back pressure valve set location is positioned vertically below the second back pressure valve set location.

A twelfth aspect of the present disclosure may include either the tenth aspect or eleventh aspect, wherein the first back pressure valve, the second back pressure valve, or both, are type-H back pressure valves.

A thirteenth aspect of the present disclosure may include any one of the tenth through thirteenth aspects, wherein the first back pressure valve set location, the second back pressure valve set location, or both, comprise a set location threaded profile that complements a back pressure valve threaded profile of the first back pressure valve, the second back pressure valve, or both, respectively.

A fourteenth aspect of the present disclosure may include the thirteenth aspect, wherein an inner diameter of the threaded profiles of first back pressure valve set location threaded profile, the second back pressure valve set location, or both, is greater than or equal to 3 inches (7.62 centimeters) and less than or equal to 6 inches (15.24 centimeters).

It is also noted that recitations herein of "at least one" component, element, etc., should not be used to create an inference that the alternative use of the articles "a" or "an" should be limited to a single component, element, etc. For example, the use of "at least one fluid control valve" should not be interpreted to mean that the wellhead can only include one fluid control valve.

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Further, it will be apparent that modifications and variations are possible without departing from the scope of the present disclosure, including, but not limited to, embodiments defined in the appended claims. More specifically, although some aspects of the present disclosure are identified herein as preferred or particularly advantageous, it is contemplated that the present disclosure is not necessarily limited to these aspects.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

What is claimed is:

1. A method of isolating production tubing in fluid communication with a wellhead, the method comprising:

removing a tree cap of a wellhead comprising a longitudinal axial bore and a tubing head adapter positioned in the longitudinal axial bore, the tubing head adapter comprising a first back pressure valve set location and a second back pressure valve set location, wherein the first back pressure valve set location comprises a first back pressure valve receiving diameter;

the second back pressure valve set location comprises a second back pressure valve receiving diameter; and the first back pressure valve receiving diameter of the first back pressure valve set location is smaller than the second back pressure valve receiving diameter of the second back pressure valve set location;

attaching a first back pressure valve to a back pressure valve running tool;

inserting the first back pressure valve and the back pressure valve running tool along the longitudinal axial bore of the wellhead into the tubing head adapter and past the second back pressure valve set location;

engaging the first back pressure valve at the first back pressure valve set location of the tubing head adapter;

releasing the first back pressure valve from the back pressure valve running tool and removing the back pressure valve running tool from the longitudinal axial bore of the wellhead;

attaching a second back pressure valve to the back pressure valve running tool;

inserting the second back pressure valve and the back pressure valve running tool along the longitudinal axial bore of the wellhead into the tubing head adapter;

engaging the second back pressure valve at the second back pressure valve set location of the tubing head adapter; and releasing the second back pressure valve from the back pressure valve running tool and removing the back pressure valve running tool from the longitudinal axial bore of the wellhead, wherein the engagement of the first back pressure valve at the first back pressure valve set location and the second back pressure valve at the second back pressure valve set location isolates the production tubing from the wellhead.

2. The method of claim 1, wherein the first back pressure valve set location is positioned vertically below the second back pressure valve set location.

3. The method of claim 1, wherein the first back pressure valve, the second back pressure valve, or both, are type-H back pressure valves.

4. The method of claim 1, wherein the first back pressure valve comprises a smaller outer diameter than the second back pressure valve.

5. The method of claim 1, wherein the first back pressure valve set location, the second back pressure valve set location, or both, comprise a set location threaded profile that complements a back pressure valve threaded profile of the first back pressure valve, the second back pressure valve, or both, respectively.

6. The method of claim 5, wherein an inner diameter of the threaded profiles of first back pressure valve set location threaded profile, the second back pressure valve set location, or both, is greater than or equal to 3 inches (7.62 centimeters) and less than or equal to 6 inches (15.24 centimeters).

7. The method of claim 1, wherein engaging the first back pressure valve at the first back pressure valve set location, engaging the second back pressure valve at the second back pressure valve set location, or both, comprises threading the back pressure valve threaded profile into the complementary set location threaded profile.

8. The method of claim 1, wherein the method further comprises pumping a fluid past the first back pressure valve and the second back pressure valve to kill the well.

9. The method of claim 1, wherein isolating production tubing in fluid communication with the wellhead does not include using a plug.

10. A wellhead for insertion above a well, the wellhead comprising:

a fluid control tree, a tubing head spool, a first back pressure valve, a second back pressure valve, and a tubing head adapter, wherein:

the fluid control tree comprises at least one fluid control valve to direct fluid along a longitudinal axial bore of the wellhead through the first back pressure valve, the second back pressure valve, and the tubing head adapter to production tubing supported by the tubing head spool and the tubing head adapter;

the tubing head spool supports the tubing head adapter and is secured to the fluid control tree via the tubing head adapter;

the tubing head adapter comprises a first back pressure valve set location that complements and engages an outer surface profile of the first back pressure valve to fix a position of the first back pressure valve in at least one direction along the longitudinal axial bore of the wellhead;

the tubing head adapter comprises a second back pressure valve set location that complements and engages an outer surface profile of the second back pressure valve to fix a position of the second back pressure valve in at least one direction along the longitudinal axial bore of the wellhead;

the first back pressure valve set location is positioned below the second back pressure valve set location;

the first back pressure valve set location comprises a first back pressure valve receiving diameter;

the second back pressure valve set location comprises a second back pressure valve receiving diameter;

the first back pressure valve receiving diameter of the first back pressure valve set location is smaller than the second back pressure valve receiving diameter of the second back pressure valve set location; and the first back pressure valve and the second back pressure valve isolate the production tubing from the wellhead.

11. The wellhead of claim 10, wherein the first back pressure valve set location is positioned vertically below the second back pressure valve set location.

12. The wellhead of claim 10, wherein the first back pressure valve, the second back pressure valve, or both, are type-H back pressure valves.

13. The wellhead of claim 10, wherein the first back pressure valve set location, the second back pressure valve set location, or both, comprise a set location threaded profile that complements a back pressure valve threaded profile of the first back pressure valve, the second back pressure valve, or both, respectively.

14. The wellhead of claim 13, wherein an inner diameter of the threaded profiles of first back pressure valve set location threaded profile, the second back pressure valve set location, or both, is greater than or equal to 3 inches (7.62 centimeters) and less than or equal to 6 inches (15.24 centimeters).

* * * * *